US010109986B2

(12) United States Patent
Niessner et al.

(10) Patent No.: US 10,109,986 B2
(45) Date of Patent: Oct. 23, 2018

(54) PRECHAMBER SPARK PLUG FOR A GAS-POWERED INTERNAL COMBUSTION ENGINE, AND METHOD FOR MANUFACTURING SAME

(71) Applicant: Federal-Mogul Ignition GmbH, Neuhaus-Schierschnitz (DE)

(72) Inventors: Werner Niessner, Steinheim (DE); Andre Seeber, Sonneberg (DE); Matthias Blankmeister, Heiligenhaus (DE); Rene Trebbels, Huckelhoven (DE); Marko Schwesinger, Sonneberg (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 15/800,816

(22) Filed: Nov. 1, 2017

(65) Prior Publication Data

US 2018/0123324 A1 May 3, 2018

(30) Foreign Application Priority Data

Nov. 3, 2016 (DE) ..... 10 2016 120 984

(51) Int. Cl.
*H01T 13/20* (2006.01)
*H01T 13/54* (2006.01)
(Continued)

(52) U.S. Cl.
CPC ..... *H01T 13/54* (2013.01); *H01T 13/08* (2013.01); *H01T 13/16* (2013.01); *H01T 13/32* (2013.01); *H01T 13/34* (2013.01); *H01T 13/39* (2013.01)

(58) Field of Classification Search
CPC ..... H01T 13/54; H01T 13/34; H01T 13/08; H01T 13/32
See application file for complete search history.

(56) References Cited

U.S. PATENT DOCUMENTS 2,361,975 A 11/1944 Sobel
4,029,982 A 6/1977 Kubota
(Continued)

FOREIGN PATENT DOCUMENTS

CA 2826807 A1 8/2012
DE 8807668 U1 9/1988
(Continued)

OTHER PUBLICATIONS

Office action issued by the German Patent and Trademark Office for application No. DE 10 2016120 984.8.

*Primary Examiner* — Donald Raleigh
(74) *Attorney, Agent, or Firm* — Reising Ethington, P.C.

(57) ABSTRACT

A prechamber spark plug for a gas-powered internal combustion engine, having a metallic body, an insulator, a center electrode, at least one ground electrode, a cap, and a sleeve. The cap is arranged at a front end of the spark plug and shields the center and ground electrodes from a combustion chamber after the prechamber spark plug is installed in the internal combustion engine, and the cap delimits a prechamber in which the center electrode and the ground electrode are located from the combustion chamber. The cap has at least one opening that permits gas exchange between the prechamber and the space outside of the prechamber. The cap is mounted on the sleeve, which surrounds a section of the body, contains external threads for screwing into the internal combustion engine, and is joined to the body. In addition, a method for manufacturing the aforementioned spark plug is described.

8 Claims, 2 Drawing Sheets

Figure 2:
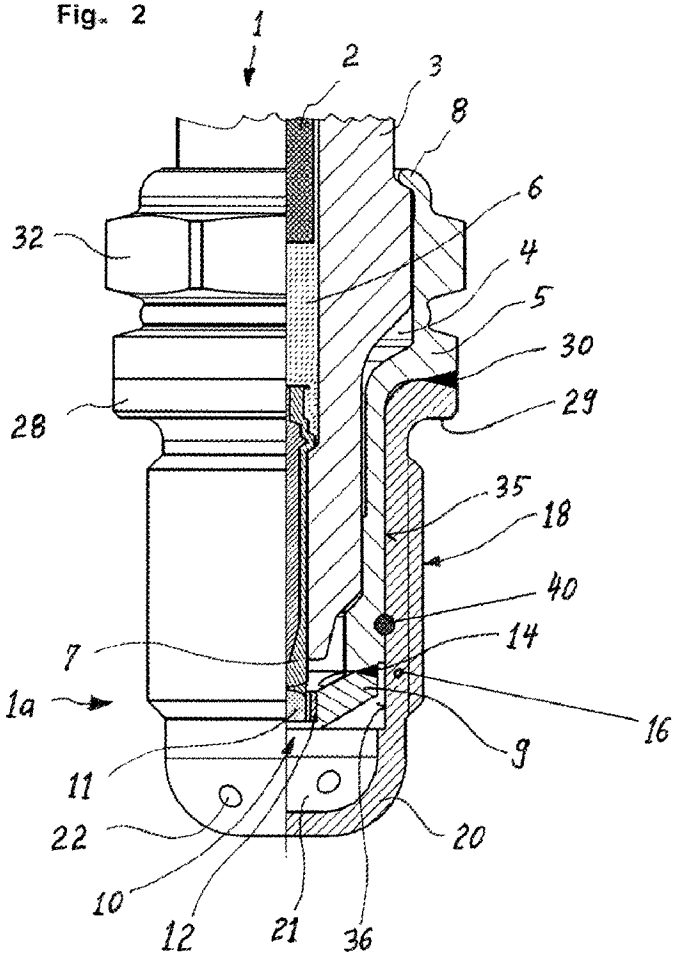

(51) Int. Cl.

| | |
|---|---|
| ***H01T 13/08*** | (2006.01) |
| ***H01T 13/32*** | (2006.01) |
| ***H01T 13/34*** | (2006.01) |
| ***H01T 13/16*** | (2006.01) |
| ***H01T 13/39*** | (2006.01) |

(56) References Cited

U.S. PATENT DOCUMENTS

| | | | |
|---|---|---|---|
| 4,490,122 | A | 12/1984 | Tromeur |
| 4,930,473 | A | 6/1990 | Dietrich |
| 6,667,568 | B1 | 12/2003 | Bugaets |
| 7,104,246 | B1 | 9/2006 | Gagliano |
| 8,053,964 | B2 | 11/2011 | Maul |
| 8,350,457 | B2 | 1/2013 | Thomas |
| 8,915,227 | B2 | 12/2014 | Johng |
| 8,937,427 | B2 | 1/2015 | Quitmeyer |
| 9,077,156 | B2 | 7/2015 | Francesconi |
| 2012/0240890 | A1* | 9/2012 | Johng ..... F02P 13/00 123/169 P |
| 2012/0242215 | A1* | 9/2012 | Hwang ..... H01T 13/54 313/143 |
| 2015/0059456 | A1 | 3/2015 | Niessner |

FOREIGN PATENT DOCUMENTS

| | | | |
|---|---|---|---|
| DE | 3913665 | A1 | 10/1990 |
| DE | 102010004851.8 | A1 | 6/2011 |
| GB | 191318727 | A | 8/1914 |
| GB | 119383 | A | 10/1918 |
| GB | 150398 | A | 8/1920 |
| JP | 2011222205 | A | 11/2011 |
| JP | 2012038524 | A | 2/2012 |
| KR | 1020040038772 | A | 12/2004 |
| WO | 031071644 | A1 | 8/2003 |
| WO | 2014/191085 | A1 | 12/2014 |

* cited by examiner

PRECHAMBER SPARK PLUG FOR A GAS-POWERED INTERNAL COMBUSTION ENGINE, AND METHOD FOR MANUFACTURING SAME

REFERENCE TO RELATED APPLICATIONS

This application claims the benefit of German Application No. 10 2016 120 984.8, filed on Nov. 3, 2016, the contents of which are hereby incorporated by reference in their entirety.

FIELD

The present invention is generally related to spark plugs, and more particularly, to spark plugs designed for a gas-powered internal combustion engines.

SUMMARY

The present design proceeds from a prechamber spark plug with the features specified in the preamble to claim 1, as well as a method for manufacturing a prechamber spark plug of this nature.

A spark plug similar to this is known from DE 10 2010 004 851 A1. In this spark plug, the center electrode and ground electrode do not project directly into the combustion chamber of the internal combustion engine, but instead into a prechamber that is formed at the front end of the spark plug and communicates with the combustion chamber of the internal combustion engine through one or more openings. As a result of the openings in the prechamber, an exchange of gas is possible between the prechamber and the combustion chamber. Such spark plugs are known as prechamber spark plugs, and are used for the ignition of lean combustion gas/air mixtures in stationary, gas-powered internal combustion engines, for example. A fuel/air mixture is referred to as lean when the ratio, lambda, of the quantity of air actually present in the combustion chamber to the quantity of air stoichiometrically required for complete combustion of the combustion gas is greater than 1, where lambda values of 1.6 to 2.0 are desired. In the compression stroke of the internal combustion engine, an ignitable mixture is introduced into the prechamber through the openings of the prechamber. In terms of its function, the prechamber is a precombustion chamber. The ignitable combustion gas/air mixture flowing into the prechamber is first ignited in the prechamber by means of an ignition spark produced between the center electrode and the ground electrode. The flame produced in the prechamber is ejected from the prechamber through the openings therein as a result of the pressure of the combustion arising in the prechamber, and ignites the lean combustion gas/air mixture present outside the precombustion chamber in the combustion chamber of the internal combustion engine.

An object of the present design is to improve a prechamber spark plug of the initially mentioned type and to create an improved method for manufacturing it.

This object may be attained by a prechamber spark plug with the features specified in the apparatus claims and a manufacturing method with the features specified in the method claims. Advantageous further developments of the design are the subject matter of the dependent claims.

The prechamber spark plug may have a metallic body, a front end and an external thread located at the front end for screwing the prechamber spark plug into an internal combustion engine. The metallic body has a passage in which an insulator is mounted. The insulator surrounds a center conductor that is connected in an electrically conductive manner to a center electrode projecting out of the insulator at the front end. At least one ground electrode is connected in an electrically conductive manner to the body, and forms a spark air gap with the center electrode. Arranged at the front end is a cap that shields the center electrode and the ground electrode from a combustion chamber of the internal combustion engine after the prechamber spark plug is installed in the internal combustion engine. The cap at the front end of the prechamber spark plug delimits a prechamber in which the center electrode and the ground electrode are located. The cap has at least one opening that permits gas exchange between the prechamber and the space outside the prechamber. The prechamber spark plug has a sleeve surrounding a section of the body. The sleeve is joined, in particular welded, to the body. The sleeve contains the external thread for screwing the prechamber spark plug into the internal combustion engine. The at least one ground electrode can be located inside the external thread of the sleeve. The external thread can surround, in particular completely surround, the at least one ground electrode. The cap is mounted on the sleeve, in particular on its front end. Cap and sleeve can be one-piece or multi-piece in design. With a one-piece design, cap and sleeve are jointly composed of a single-piece component. With a multi-piece design, the cap can be welded to the sleeve.

In the method for manufacturing a prechamber spark plug, an insulator that contains a center conductor and a center electrode is placed in a metallic body having a passage and is secured therein. Then, at least one ground electrode, which forms a spark air gap with the center electrode, is attached to the body. After attachment of the at-least-one ground electrode, a sleeve is attached to the body. The sleeve contains an external thread for screwing the prechamber spark plug into the internal combustion engine. The sleeve is attached, in particular welded, to the body in such a manner that the sleeve surrounds a section of the body, and the cap mounted on the sleeve delimits a prechamber in which the center electrode and the ground electrode are located. In this context, the cap can be mounted on the sleeve either before or after attachment of the sleeve. A cap that has already been mounted on the sleeve when the sleeve is attached can be prefabricated as one piece with the sleeve. A cap that is not yet mounted on the sleeve when the sleeve is attached can be attached, in particular welded, to the front end of the sleeve afterward.

The present design may have the following advantages:

- The prechamber at the front end of the spark plug is not created until after the sleeve is placed on the body. Consequently, the mounting of the ground electrode can take place on the front end of the body, which is still easily accessible beforehand. In contrast to the design known from DE 10 2010 004 851 A1, no operations inside a difficult-to-access cavity that forms a part of the prechamber are required during attachment of the ground electrode. Mounting of the ground electrode is thus vastly simplified. Furthermore, tolerances in mounting can be tightened so that the desired electrode spacing can be maintained more precisely.
- The ground electrode can be welded to the body more easily and conveniently. In particular, the ground electrode can be welded to an end face of the body facing the front end. During attachment by welding, large-area fused joints can be created between ground electrode and body, in particular by means of a laser beam directed transversely to the longitudinal direction of the spark plug as long as the sleeve has not yet been joined to the body. In this way, it is also possible to reduce dark deposits of welding fumes on the insulator that can lead to a reduction in the insulating properties.

Relatively large bonding surfaces can be achieved between ground electrode and body, permitting very good dissipation of combustion heat from the ground electrode and the prechamber, and thereby improving the ignition performance of the prechamber spark plug. In particular, the tendency toward undesirable pre-ignition can be reduced.

Even though the prechamber spark plug contains an additional part with the sleeve according to the current design, reduced overall manufacturing effort results because of the improved accessibility during mounting of the ground electrode.

In a further embodiment, the sleeve can contain the entire external thread for screwing into the internal combustion engine. An external thread that is located entirely on the sleeve permits tight manufacturing tolerances on the external thread so that it is possible to ensure that the prechamber spark plug can be reliably screwed into and out of the internal combustion engine. The at-least-one ground electrode and the body can be joined with at least one weld seam, which can run in the circumferential direction of the body, in particular. The sleeve can surround this weld seam, in particular with a section containing the external thread. The body can have an external surface that is cylindrical, in particular circular cylindrical. The sleeve can have an internal surface that is cylindrical, in particular circular cylindrical. The cylindrical internal surface of the sleeve can be placed on the cylindrical external surface of the body. The ground electrode can be welded to the body along the outer circumference of the body, in particular by means of a laser beam directed transversely to the longitudinal direction of the spark plug.

In a further embodiment, the sleeve can include a collar at an end facing away from the cap. The collar can be welded to the body, in particular along the entire outer circumference. The collar takes the form of a flange extending along the entire circumference, and has a larger external diameter than the external thread. A sealing shoulder, in particular in the form of a flat annular surface, that limits the prechamber spark plug screwing into the internal combustion engine can be located on the side of the collar facing the front end.

The joint between the sleeve and the body should be be gas-tight such that escape of combustion gases from the prechamber through the location of the joint between sleeve and body is prevented. This can be achieved through gas-tight welding of sleeve and body. In addition or alternatively to a gas-tight weld, a seal, in particular a seal ring, can be arranged between the body and the sleeve. Especially in the case of a multi-piece design prior to mounting of the cap, the sleeve can be welded to the body continuously in the circumferential direction along the sleeve's internal surface. In combination with the weld seam on the collar, the sleeve can thus be joined to the body by two weld seams. This can improve leak-tightness in the event of high pressures.

DRAWINGS

Figure 1:
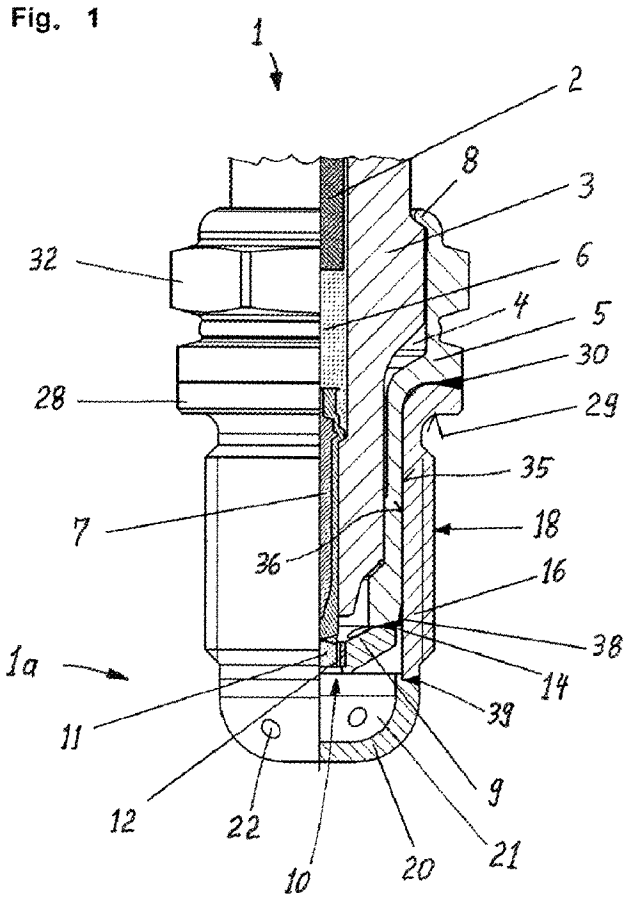
Figure 3:
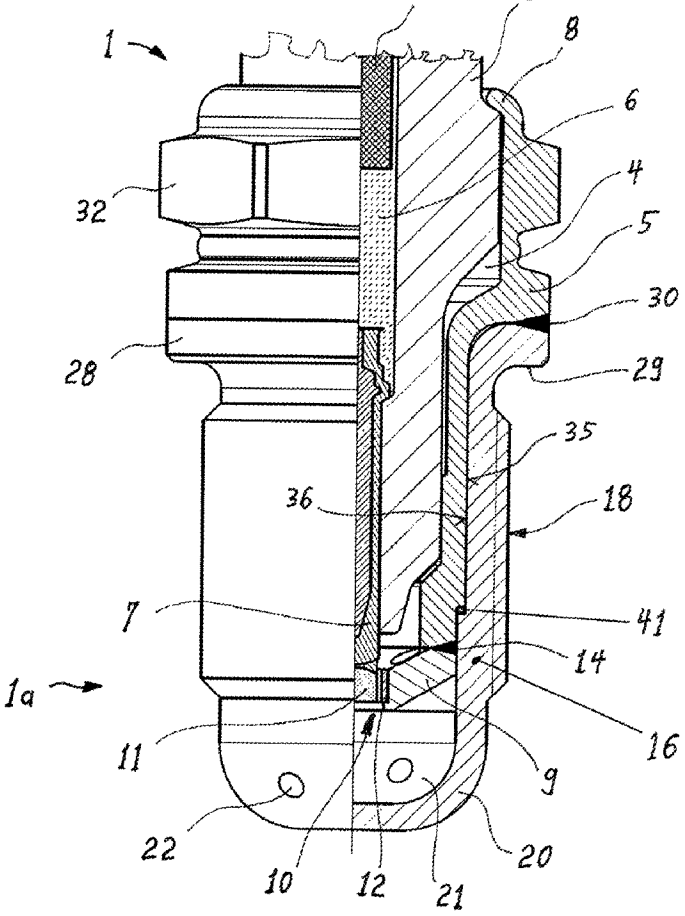

Additional advantages and features of the current design are evident from the description below of some exemplary embodiments in conjunction with the figures. Shown are:

FIG. 1 a partially sectional view of a prechamber spark plug in the region of its front end, FIG. 2 a view similar to FIG. 1 of a second exemplary embodiment, FIG. 3 a view similar to FIG. 1 of a third exemplary embodiment.

DESCRIPTION

Shown in FIGS. 1 to 3 is a prechamber spark plug 1 in the region of a front end 1*a*. Identical reference numbers label identical parts. The prechamber spark plug 1 contains a center conductor 2, which is surrounded by an insulator 3. The insulator 3 is seated in a passage 4 of a metallic body 5. The center conductor 2 is connected in an electrically conductive manner by a fused glass element 6 to a center electrode 7, which projects out of the insulator 3 at the front end 1*a*. Insertion and attachment of the insulator 3 in the passage 4 of the body 5 takes place in a manner that is known per se, in that an edge 8 at the back end of the body 5 is flanged and then an axial preloading of the insulator 3 in the body 5 is created by a shrinkage process called "electro-upsetting". Welded to an end face of the body 5 facing the front end 1*a* is a ground electrode 9. The ground electrode 9 is connected in an electrically conductive manner to the body 5, and forms a spark air gap 10 with the center electrode 7. The center electrode 7 and the ground electrode 9 can be reinforced with a precious metal component 11 and 12, respectively, in a manner that is known per se. The ground electrode 9 is an annular electrode that surrounds the circumferential surface of the center electrode 7 or of the precious metal component 11. The ground electrode 9 and the body 5 are joined by a weld seam 14 extending completely and continuously in the circumferential direction of the body 5. The weld seam 14 ensures a large-area joint between ground electrode 9 and body 5, and ensures good dissipation of heat from the ground electrode 9 to the body 5.

The prechamber spark plug 1 has a sleeve 16, which contains an external thread 18 for screwing the prechamber spark plug 1 into an internal combustion engine. At the front end, the sleeve 16 contains a cap 20 that shields the center electrode 7 and the ground electrode 9 from a combustion chamber of the internal combustion engine after the prechamber spark plug 1 has been installed in the internal combustion engine, and that delimits a prechamber 21 in which the center electrode 7, in particular with its precious metal component 11, and the ground electrode 9 are located. The cap 20 has multiple openings 22 that permit gas exchange between the prechamber 21 and the space outside the prechamber 21. In the exemplary embodiment from FIG. 1, the sleeve 16 is two-piece in design, in that the cap 20 is welded onto the front end of the sleeve 16. In the exemplary embodiments from FIGS. 2 and 3, the sleeve 16 is designed as a single piece with the cap 20. At its back end, which faces away from the cap 20, the sleeve 16 has a collar 28, the external diameter of which is larger than the diameter of the external thread 18. Arranged on the side of the collar 28 facing the front end 1*a* is a flat annular surface 29, through which the prechamber spark plug 1 rests on the internal combustion engine after being screwed into the same. Sealing is accomplished at the annular surface or sealing shoulder 29, if applicable with a seal ring (not shown) interposed. On its side facing away from the front end 1*a*, the collar 28 is welded to the body 5, namely with a weld seam 30 extending continuously around the entire outer circumference of the body. The weld seam 30 is designed to be sufficiently strong that a tightening torque and an unscrewing torque introduced to an external hexagon 32 in the body 5 when the prechamber spark plug 1 is screwed into or out of the internal combustion engine can be reliably transmitted to the sleeve 16. In the case of a prechamber spark plug 1 with an M18 external thread 18, the weld seam 30 should be able to reliably transmit at least 150 Nm.

The body 5 has a cylindrical external surface 35. The sleeve 16 has a cylindrical internal surface 36. The cylindrical internal surface 36 of the sleeve 16 is placed or pressed onto the cylindrical external surface 35. So that no combustion gases can escape rearward from the prechamber 21, the joint between body 5 and sleeve 16 is sealed in the region of the cylindrical surfaces 35, 36. In the exemplary embodiment from FIG. 1, the sealing is accomplished by a weld seam 38 between the cylindrical internal surface 36 and the cylindrical external surface 35 along the end face of the body 5 facing the front end 1*a*. In the exemplary embodiment from FIG. 2, the sealing is accomplished by a radial seal ring 40 arranged between the surfaces 35 and 36. In the exemplary embodiment from FIG. 3, a step or shoulder is provided on each of the surfaces 35 and 36, and a flat seal ring 41 is arranged between them.

In manufacturing the prechamber spark plug 1, first the insulator 3 is made of ceramic. Next, the center conductor 2, the center electrode 7, and the fused glass element 6 are inserted in the insulator 3. Next, the insulator 3 is installed in the passage 4 of the body 5 in a manner that is known per se. The sleeve 16 has not yet been placed on the body 5. As a result, the end face of the body 5 facing the front end 1*a* is freely accessible, and the ground electrode 9 can easily and conveniently be placed on the body 5 and large-area welded with the weld seam 14 along the entire circumference. The weld seam 14 can be produced by means of a laser beam directed transversely to the longitudinal direction of the prechamber spark plug 1. The operating temperature of the ground electrode 9 can be kept below 800° C. with this large-area joint.

After the ground electrode 9 has been attached by welding, in the exemplary embodiment from FIG. 1 the sleeve 16 containing the external thread 18 is placed on the front end of the body 5 and welded to the body 5 at the weld seam 30. Here, the sleeve 16 is prefabricated only with the external thread 18, while the cap 20 is not yet included. The weld seam 38 is now produced with a laser beam directed in the longitudinal direction of the prechamber spark plug 1. In conclusion, the cap 20 is placed on the sleeve 16 at the front end 1*a*, and welded thereto with the weld seam 39.

In the exemplary embodiments from FIGS. 2 and 3, the sleeve 16 is prefabricated as a single piece with the external thread 18 and the cap 20. After the ground electrode 9 has been welded on, the seal 40 or 41 is set in place and then the sleeve 16 equipped with external thread 18 and cap 20 is placed on the front end of the body 5. Then the sleeve 16 is joined to the body 5 by the weld seam 30, and the prechamber spark plug 1 is completed.

LIST OF REFERENCE NUMERALS

1 prechamber spark plug
1*a* front end
2 center conductor
3 insulator
4 passage
5 body
6 fused glass element
7 center electrode
8 edge
9 ground electrode
10 spark air gap
11 precious metal component
12 precious metal component
14 weld seam
16 sleeve
18 external thread
20 cap
21 prechamber
22 opening
28 collar
29 annular surface
30 weld seam
32 external hexagon
35 cylindrical external surface
36 cylindrical internal surface
38 weld seam
39 weld seam
40 radial seal ring
41 flat seal ring

The invention claimed is:

1. A prechamber spark plug for a gas-powered internal combustion engine, comprising:

a metallic body, a front end, and an external thread located at the front end for screwing the prechamber spark plug into the internal combustion engine;

the metallic body has a passage in which an insulator is mounted that surrounds a center conductor, which is connected in an electrically conductive manner to a center electrode projecting out of the insulator at the front end;

at least one ground electrode is connected in an electrically conductive manner to the body, and forms a spark air gap with the center electrode;

arranged at the front end is a cap that shields the center electrode and the ground electrode from a combustion chamber of the internal combustion engine after the prechamber spark plug is installed in the internal combustion engine, and that delimits a prechamber in which the center electrode and the ground electrode are located from the combustion chamber; and the cap has at least one opening that permits gas exchange between the prechamber and the space outside of the prechamber, wherein the cap is mounted on a sleeve surrounding a section of the body, and the sleeve contains the external thread for screwing into the internal combustion engine and is joined to the body, wherein the sleeve includes a collar at an end facing away from the cap and the collar is welded to the body.

2. The prechamber spark plug according to claim 1, wherein the sleeve contains the entire external thread for screwing into the internal combustion engine.

3. The prechamber spark plug according to claim 1, wherein the at least one ground electrode is located inside the external thread of the sleeve.

4. The prechamber spark plug according to claim 1, wherein a seal ring is arranged between the body and the sleeve.

5. The prechamber spark plug according to claim 1, wherein the at least one ground electrode and the body are joined by at least one weld seam, in particular extending continuously in the circumferential direction of the body, and in which the sleeve surrounds this aforementioned weld seam, in particular with a section containing the external thread.

6. The prechamber spark plug according to claim 1, wherein the body has a cylindrical external surface and the sleeve has a cylindrical internal surface, wherein the cylindrical internal surface of the sleeve is placed on the cylindrical external surface of the body.

7. A prechamber spark plug for a gas-powered internal combustion engine, comprising:

a metallic body, a front end, and an external thread located at the front end for screwing the prechamber spark plug into the internal combustion engine;

the metallic body has a passage in which an insulator is mounted that surrounds a center conductor, which is connected in an electrically conductive manner to a center electrode projecting out of the insulator at the front end;

at least one ground electrode is connected in an electrically conductive manner to the body, and forms a spark air gap with the center electrode;

arranged at the front end is a cap that shields the center electrode and the ground electrode from a combustion chamber of the internal combustion engine after the prechamber spark plug is installed in the internal combustion engine, and that delimits a prechamber in which the center electrode and the ground electrode are located from the combustion chamber; and the cap has at least one opening that permits gas exchange between the prechamber and the space outside of the prechamber, wherein the cap is mounted on a sleeve surrounding a section of the body, and the sleeve contains the external thread for screwing into the internal combustion engine and is joined to the body, wherein the sleeve is welded continuously in the circumferential direction along its internal surface to the body.

8. A method for manufacturing a prechamber spark plug, the method comprising the steps of:

placing an insulator that contains a center conductor and a center electrode in a metallic body having a passage and securing therein;

attaching at least one ground electrode, which forms a spark air gap with the center electrode, to the body by welding the at least one ground electrode to the body along the outer circumference thereof with a weld seam extending continuously around the entire outer circumference of the body; and after attachment of the at least one ground electrode, attaching a sleeve that contains an external thread for screwing the prechamber spark plug into the internal combustion engine to the body, wherein the sleeve is attached in such a manner that the sleeve surrounds a section of the body and a cap mounted on the sleeve delimits a prechamber in which the center electrode and the ground electrode are located.

* * * * *